US008275285B2

(12) United States Patent
Kawakami et al.

(10) Patent No.: US 8,275,285 B2
(45) Date of Patent: Sep. 25, 2012

(54) PROCESS CARTRIDGE AND IMAGE FORMING APPARATUS

(75) Inventors: Yoshihiro Kawakami, Hyogo (JP); Koji Kato, Ibaraki (JP); Hirobumi Ooyoshi, Ibaraki (JP); Tomofumi Yoshida, Ibaraki (JP); Kenzo Tatsumi, Osaka (JP); Yoshiyuki Shimizu, Osaka (JP); Tomohiro Kubota, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 1252 days.

(21) Appl. No.: 12/036,034

(22) Filed: Feb. 22, 2008

(65) Prior Publication Data

US 2008/0205930 A1 Aug. 28, 2008

(30) Foreign Application Priority Data

Feb. 26, 2007 (JP) ..... 2007-045212

(51) Int. Cl.
*G03G 21/18* (2006.01)
*G03G 21/16* (2006.01)

(52) U.S. Cl. ..... 399/111; 399/107; 399/113

(58) Field of Classification Search ..... 399/107, 399/110–113
See application file for complete search history.

(56) References Cited

U.S. PATENT DOCUMENTS

| | | | | |
|---|---|---|---|---|
| D322,279 | S | 12/1991 | Tsutsui | |
| 5,270,784 | A * | 12/1993 | Nakane et al. | 399/49 |
| D378,830 | S | 4/1997 | Kim | |
| D398,633 | S | 9/1998 | Hashizume et al. | |
| D401,618 | S | 11/1998 | Ikehata | |
| 6,016,413 | A * | 1/2000 | Yokoyama et al. | 399/113 |
| 6,118,959 | A | 9/2000 | Michlin | |
| 6,154,623 | A | 11/2000 | Suzuki et al. | |
| D442,214 | S | 5/2001 | Hayashi | |
| D442,624 | S | 5/2001 | Maeshima | |
| 6,246,848 | B1 | 6/2001 | Morinaga et al. | |
| D459,388 | S | 6/2002 | Irie et al. | |
| D478,617 | S | 8/2003 | Kinoshita et al. | |
| D491,979 | S | 6/2004 | Irie et al. | |
| D501,021 | S | 1/2005 | Saiki et al. | |
| D506,776 | S | 6/2005 | Kobayashi et al. | |
| D519,150 | S | 4/2006 | Kojima et al. | |

(Continued)

FOREIGN PATENT DOCUMENTS

JP 6-332304 2/1994

(Continued)

OTHER PUBLICATIONS

Office Action issued Aug. 2, 2011 in Japan Application No. 2007-045212.

(Continued)

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

A process cartridge includes a photosensitive drum, a charging unit, a developing unit, and a cleaning unit, arranged opposite to each other along a rotating direction of the photosensitive drum in an enclosure that has an opening opposite to a developing roller of the developing unit. An extended line connecting a tangent line to an outer circumference of the developing roller and a wall of a first end of the enclosure in an axial direction of the developing roller does not intersect with a wall of a second end of the enclosure.

11 Claims, 5 Drawing Sheets

U.S. PATENT DOCUMENTS

| | | | | |
|---|---|---|---|---|
| 7,027,755 | B2 * | 4/2006 | Ito et al. | 399/111 |
| D524,849 | S | 7/2006 | Komai | |
| D525,289 | S | 7/2006 | Murata | |
| 7,136,608 | B2 | 11/2006 | Miller | |
| D553,673 | S | 10/2007 | Ikeda | |
| D580,968 | S | 11/2008 | Tatsumi et al. | |
| D590,011 | S | 4/2009 | Tatsumi et al. | |
| D590,012 | S | 4/2009 | Tatsumi et al. | |
| D597,129 | S | 7/2009 | Tatsumi et al. | |
| D603,450 | S | 11/2009 | Tatsumi et al. | |
| 2004/0234293 | A1 * | 11/2004 | Karakama et al. | 399/111 |
| 2006/0127128 | A1 * | 6/2006 | Horikawa | 399/111 |
| 2007/0122175 | A1 * | 5/2007 | Sato | 399/90 |
| 2007/0280743 | A1 * | 12/2007 | Nakajima et al. | 399/262 |

FOREIGN PATENT DOCUMENTS

| | | |
|---|---|---|
| JP | 06-258911 | 9/1994 |
| JP | 8-146744 | 6/1996 |
| JP | 2001-117470 | 4/2001 |
| JP | 3342362 | 8/2002 |
| JP | 2002-268517 A | 9/2002 |
| JP | 2002-268517 A5 | 9/2002 |
| JP | 2003-050505 | 2/2003 |
| JP | 2003-076106 | 3/2003 |
| JP | 2003-122122 | 4/2003 |
| JP | 2003-131471 | 5/2003 |
| JP | 2004-264460 | 9/2004 |
| JP | 2005-77743 | 3/2005 |
| JP | 2006-106134 | 4/2006 |
| JP | 2006-195401 | 7/2006 |
| JP | 2006-279877 | 10/2006 |

OTHER PUBLICATIONS

Japanese Office Action mailed on Jan. 17, 2012, issued for Japanese Application No. 2007-045212, filed on Feb. 26, 2007.

* cited by examiner

PROCESS CARTRIDGE AND IMAGE FORMING APPARATUS

CROSS-REFERENCE TO RELATED APPLICATIONS

The present application claims priority to and incorporates by reference the entire contents of Japanese priority document 2007-045212 filed on Feb. 26, 2007.

BACKGROUND OF THE INVENTION

1. Field of the Invention

The present invention relates to a process cartridge and an image forming apparatus.

2. Description of the Related Art

In an image forming apparatus, such as a copier, a printer, a facsimile machine, and a digital multifunction product including a plurality of functions, the one capable of forming a color image has been widely used in recent years. Particularly, a tandem-type color image forming apparatus including a plurality of image carriers is becoming the mainstream because of its high-speed performance. As an example of the tandem-type color image forming apparatus, Japanese Patent Application Laid-open No. 2006-195401 discloses the one in which the same size and shape of four process cartridges are arranged in parallel to one another. In this technology, when a toner contained in the process cartridge is run out, the process cartridge needs to be replaced by a user. The four process cartridges respectively contain yellow, magenta, cyan, and black color toners, and positions of the process cartridges are fixed in advance based on colors of the toners.

However, it is difficult for the user to identify the colors of the toners. The only way the user identifies the colors of the toners is to check an assembly certification issued when the toner is preset in the process cartridge. Therefore, there is a possibility that the process cartridge is mistakenly labeled as a toner of which color is different from an actual toner color. In this case, the image forming apparatus fails to form a proper color image.

Furthermore, if a developing unit or the like is arranged as close as possible to the process cartridges to downsize the image forming apparatus, the user inevitably has a difficulty in replacing the process cartridge. To solve the problem, for example, a handle can be provided to the process cartridge so that the process cartridge can be easily attached to or taken out from the image forming apparatus with an emphasis on the handling ability. However, due to the handle, a size of the process cartridge increases, and thus a size of the image forming apparatus also increases. Moreover, the handle needs to be fitted in view of a layout of the image forming apparatus, otherwise the handle may interfere a light path of a laser located near the process cartridges.

SUMMARY OF THE INVENTION

It is an object of the present invention to at least partially solve the problems in the conventional technology.

According to an aspect of the present invention, there is provided a process cartridge that is configured to be attached to a main body of an image forming apparatus in a detachable manner. The process cartridge includes photosensitive drum that is rotatably supported; a charging unit that uniformly charges the photosensitive drum; a developing unit that develops an electrostatic latent image formed on the photosensitive drum with toner to form a toner image on the photosensitive drum; and a cleaning unit that cleans residual toner around the photosensitive drum after transferring the toner image onto an intermediate transfer unit. The photosensitive drum, the charging unit, the exposing unit, the developing unit, and the cleaning unit are arranged opposite to each other along a rotating direction of the photosensitive drum in an enclosure. The enclosure has an opening opposite to a developing roller of the developing unit. An extended line passing through a tangent line to an outer circumference of the developing roller and a wall of a first end of the enclosure in an axial direction of the developing roller does not intersect with a wall of a second end of the enclosure.

Furthermore, according to another aspect of the present invention, there is provided an image forming apparatus including a process cartridge that is configured to be attached to a main body of an image forming apparatus in a detachable manner. The process cartridge includes a photosensitive drum that is rotatably supported, a charging unit that uniformly charges the photosensitive drum, a developing unit that develops the electrostatic latent image formed on the photosensitive drum with toner to form a toner image on the photosensitive drum, and a cleaning unit that cleans residual toner around the photosensitive drum after transferring the toner image onto an intermediate transfer unit. The photosensitive drum, the charging unit, the developing unit, and the cleaning unit are arranged opposite to each other along a rotating direction of the photosensitive drum in an enclosure. The enclosure has an opening opposite to a developing roller of the developing unit. An extended line passing through a tangent line to an outer circumference of the developing roller and a wall of a first end of the enclosure in an axial direction of the developing roller does not intersect with a wall of a second end of the enclosure.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
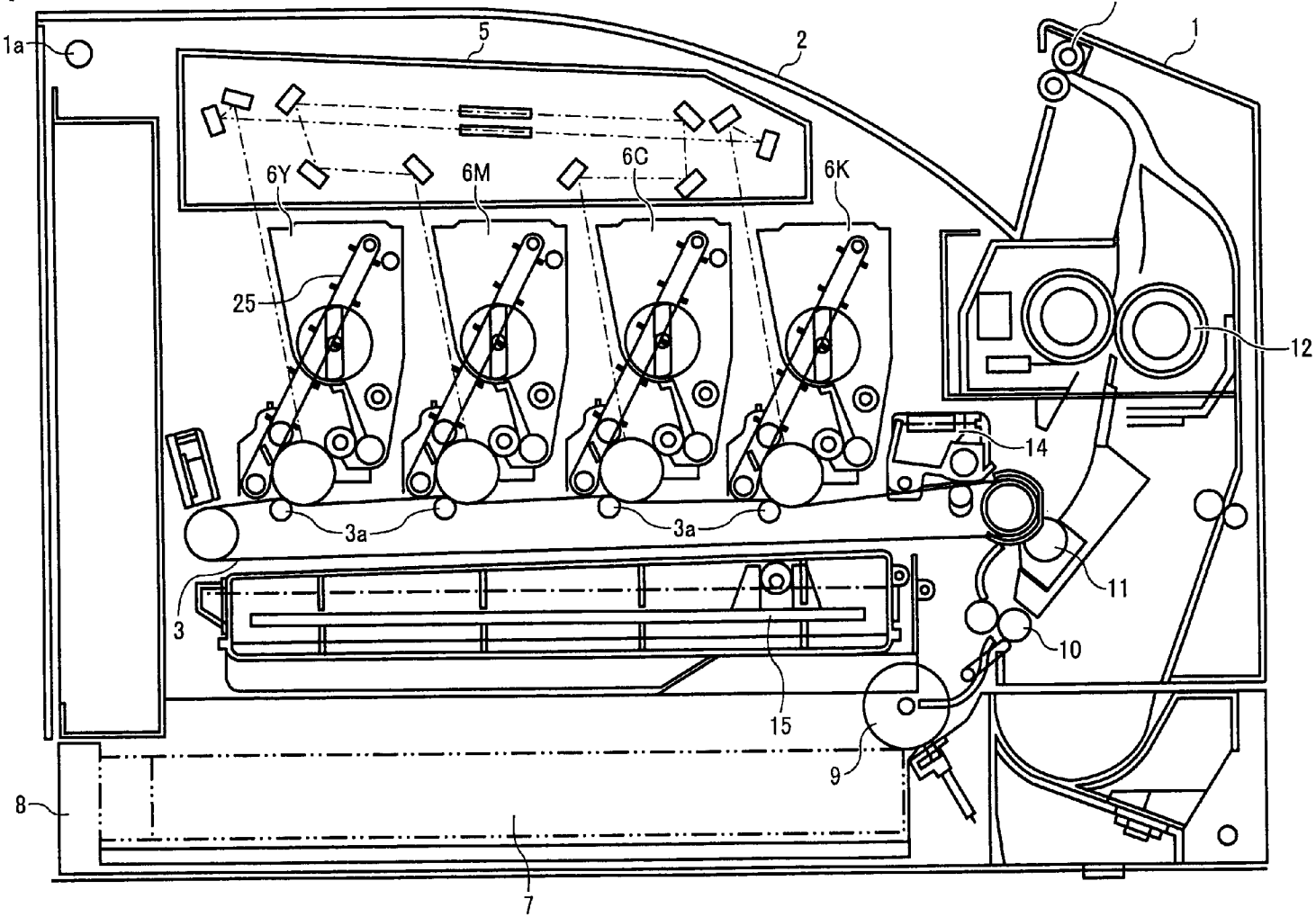
FIG. 1 is a schematic diagram of a color printer as an example of an image forming apparatus according to an embodiment of the present invention.

FIG. 1 is a schematic diagram of a color printer 1 as an example of an image forming apparatus according to an embodiment of the present invention. The color printer 1 includes four image forming units 6Y, 6M, 6C, and 6K, an exposing unit 5, an intermediate transfer belt 3 as an intermediate transfer unit, a secondary transfer unit 11, an intermediate-transfer-belt cleaning unit 14, a waste-toner container 15, a sheet cassette 8, a sheet feed roller 9, a fixing unit 12, primary transfer rollers 3*a*, a sheet conveying unit 10, a pair of discharging rollers 13, and an upper cover 2. The image forming units 6Y, 6M, 6C, and 6K are arranged in parallel to one another in the substantially middle of an enclosure of the color printer 1. The exposing unit 5 is arranged above the image forming units 6Y, 6M, 6C, and 6K, and used when a latent image is formed on a photosensitive drum included in each of the image forming units 6Y, 6M, 6C, and 6K. The intermediate transfer belt 3 is horizontally arranged below the image forming units 6Y, 6M, 6C, and 6K, and supported by a plurality of supporting rollers. The secondary transfer unit 11 and the intermediate-transfer-belt cleaning unit 14 are arranged on the right side of the intermediate transfer belt 3 in FIG. 1. The waste-toner container 15 and the sheet cassette 8 are arranged below the intermediate transfer belt 3. The waste-toner container 15 is opposed to the intermediate transfer belt 3. The sheet cassette 8 contains therein a stack of recording media. A recording medium 7 fed from the sheet cassette 8 by the sheet feed roller 9 is conveyed by passing between the intermediate transfer belt 3 and the secondary transfer unit 11, and guided to the fixing unit 12 so that the fixing unit 12 fixes a toner image on the recording medium 7 by the application of heat.

Figure 2:
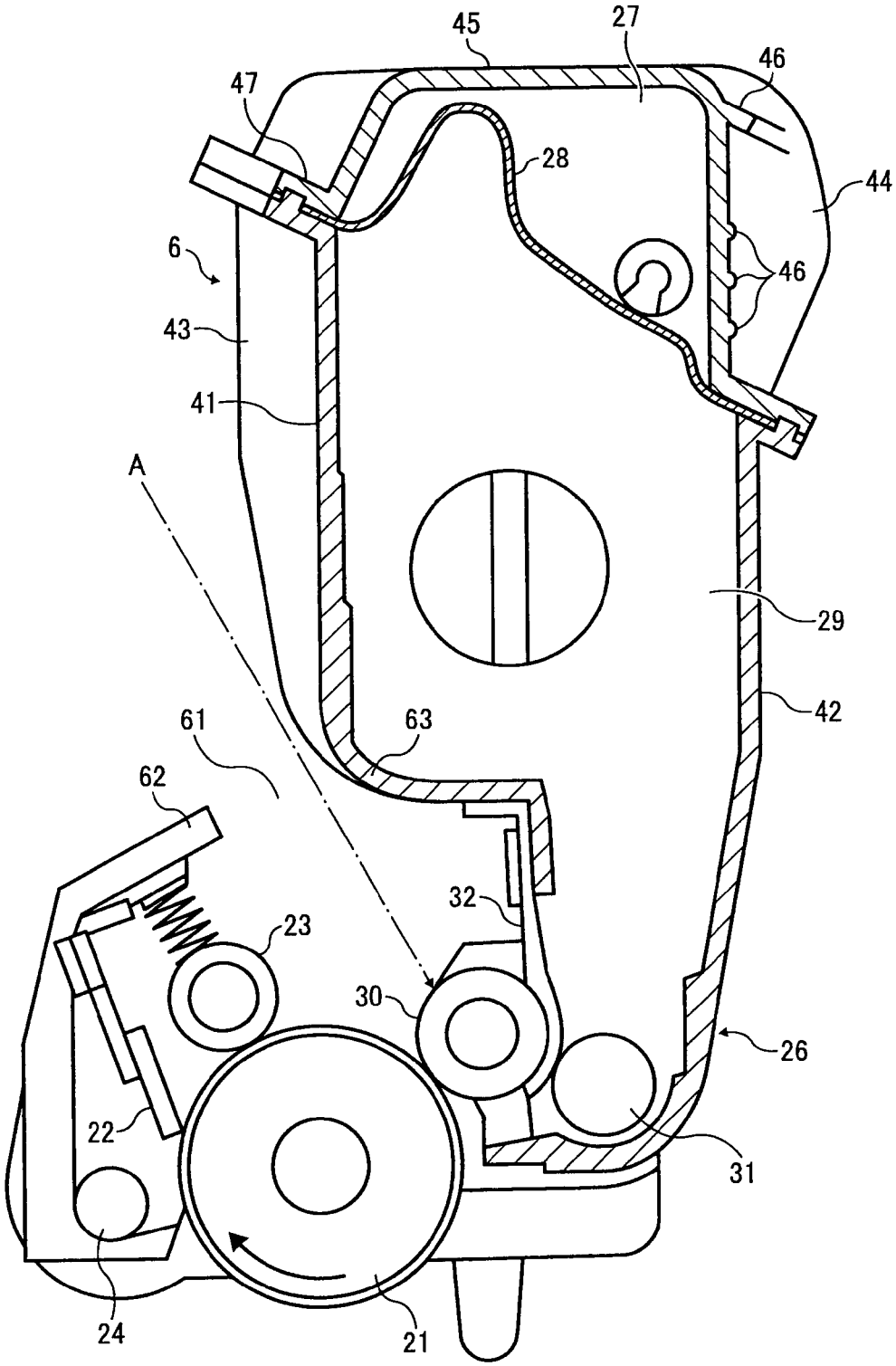
FIG. 2 is an enlarged view of an image forming unit of the color printer shown in FIG. 1.

The image forming units 6Y, 6M, 6C, and 6K form yellow (Y), magenta (M), cyan (C), and black (K) toner images, respectively. All the image forming units 6Y, 6M, 6C, and 6K have the same configuration and function except for a color of a toner image to be formed. Therefore, each of the image forming units 6Y, 6M, 6C, and 6K is referred to as an image forming unit 6 for simplicity. FIG. 2 is an enlarged view of the image forming unit 6. The image forming unit 6 includes a photosensitive drum 21 as an image carrier, a cleaning blade 22 as a cleaning unit, a charging roller 23 as a charging unit, a toner conveying coil 24, a toner conveying belt 25 (see FIG. 1), and a developing unit 26. The photosensitive drum 21 is arranged in the bottom of the image forming unit 6 to be opposed to the intermediate transfer belt 3, and driven to rotate in a clockwise direction. The cleaning blade 22 and the charging roller 23 are arranged around the photosensitive drum 21. The cleaning blade 22 scrapes off a residual toner after a toner image formed on the photosensitive drum 21 is primarily transferred onto the intermediate transfer belt 3. The charging roller 23 has contact with the photosensitive drum 21. The toner conveying coil 24 is arranged near the cleaning blade 22, and conveys the scraped residual toner in a horizontal direction. The scraped residual toner conveyed by the toner conveying coil 24 is collected by the toner conveying belt 25, and put into a waste-toner chamber 27 of the developing unit 26. The developing unit 26 is divided into the waste-toner chamber 27 and an unused-toner chamber 29 by a partition member 28. The partition member 28 is made of a flexible material such as a film. The unused-toner chamber 29 occupies a central area of the developing unit 26, and is filled with a predetermined color toner as a colored fine powder. The developing unit 26 further includes a developing roller 30, an agitator (not shown), an agitating roller (not shown), a toner refilling roller 31, and a developing blade 32. The developing roller 30 is arranged to be opposed to the photosensitive drum 21 with keeping a slight gap between them or having contact with the photosensitive drum 21.

Subsequently, an electrophotographic image forming process is explained below. When the photosensitive drum 21 shown in FIG. 2 is driven to rotate in the clockwise direction by a drive unit (not shown), a photosensitive layer formed on a surface of the photosensitive drum 21 is uniformly charged to a high potential by the charging roller 23 to be initialized. The uniformly-charged photosensitive layer is selectively exposed by the exposing unit 5 based on image data. As a result, an electrostatic latent image composed of a low potential portion in which the high potential is reduced due to the exposure and a high potential portion in which the high potential obtained at the time of initialization is kept is formed. When the low potential portion (or the high potential portion) of the electrostatic latent image comes to a contact point between the photosensitive drum 21 and the developing roller 30, a toner is passed from a surface of the developing roller 30 on which a toner thin layer is formed to the low potential portion (or the high potential portion) of the electrostatic latent image, and thereby forming (developing the electrostatic latent image into) a toner image. After the toner image is primarily transferred onto the intermediate transfer belt 3, a residual toner is removed from the surface of the photosensitive drum 21 by the cleaning blade 22 having contact with the photosensitive drum 21, and a residual charge is removed from the surface of the photosensitive drum 21 by a neutralization device (not shown) to prepare for a toner image to be formed next.

The primary transfer roller 3*a* (see FIG. 1) is arranged to be opposed to a portion where the image forming unit 6 has contact with the intermediate transfer belt 3. By applying a high potential to the primary transfer roller 3*a*, a potential difference between the photosensitive drum 21 and the intermediate transfer belt 3 is generated, so that the toner image formed on the surface of the photosensitive drum 21 is transferred onto the intermediate transfer belt 3. If a color image is to be formed, Y, M, C, and K toner images formed by the image forming units 6Y, 6M, 6C, and 6K are sequentially transferred onto the intermediate transfer belt 3 in a superimposed manner, and a multiple-color toner image, which is the superimposed Y, M, C, and K toner images, is formed on the intermediate transfer belt 3. On the other hand, the recording medium 7 fed by the sheet feed roller 9 is conveyed to the secondary transfer unit 11 via the sheet conveying unit 10 at a predetermined timing. By applying a high potential to the secondary transfer unit 11, a potential difference between the intermediate transfer belt 3 and the secondary transfer unit 11 is generated, so that the multiple-color toner image (or the single-color toner image in some cases) transferred onto the surface of the intermediate transfer belt 3 is transferred onto the recording medium 7. The recording medium 7 onto which the toner image is transferred is detached from the intermediate transfer belt 3, and conveyed to the fixing unit 12. The toner image is fused and fixed on the recording medium 7 by the fixing unit 12. After that, the recording medium 7 is discharged onto a copy receiving tray that is an upper surface of the upper cover 2 via the discharging rollers 13. After the toner image on the surface of the intermediate transfer belt 3 is transferred onto the recording medium 7, a residual toner is removed from the surface of the intermediate transfer belt 3 by the intermediate-transfer-belt cleaning unit 14, and the removed residual toner is put into the waste-toner container 15 so that the intermediate transfer belt 3 can be prepared for a toner image to be transferred thereonto next.

The image forming unit 6 is configured as a process cartridge into which the photosensitive drum 21, the developing unit 26, the charging roller 23, and the cleaning blade 22 are integrated. When a toner contained in the unused-toner chamber 29 is run out, the image forming unit 6 needs to be replaced with the new one.

Figure 3:
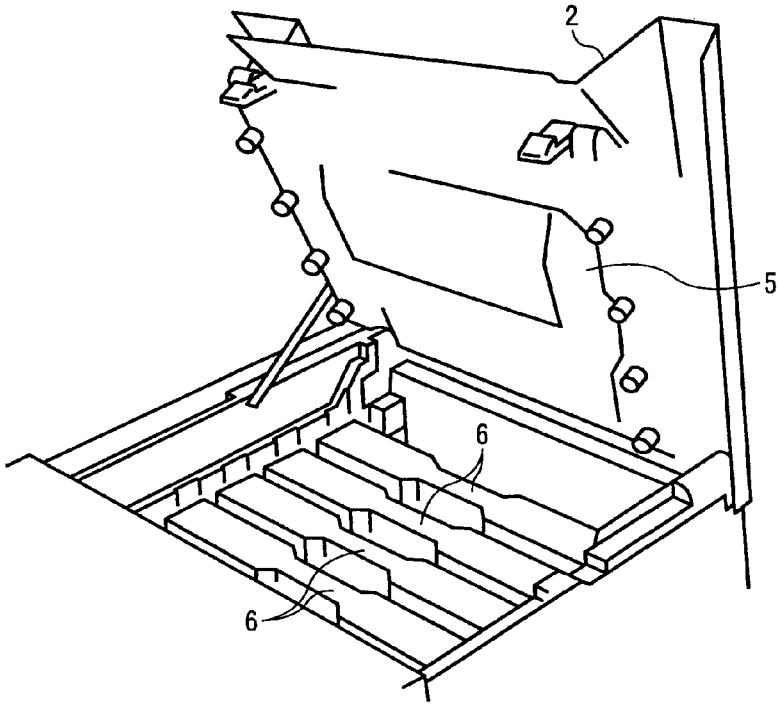
FIG. 3 is a perspective view of the color printer when an upper cover of the color printer is opened.
Figure 4:
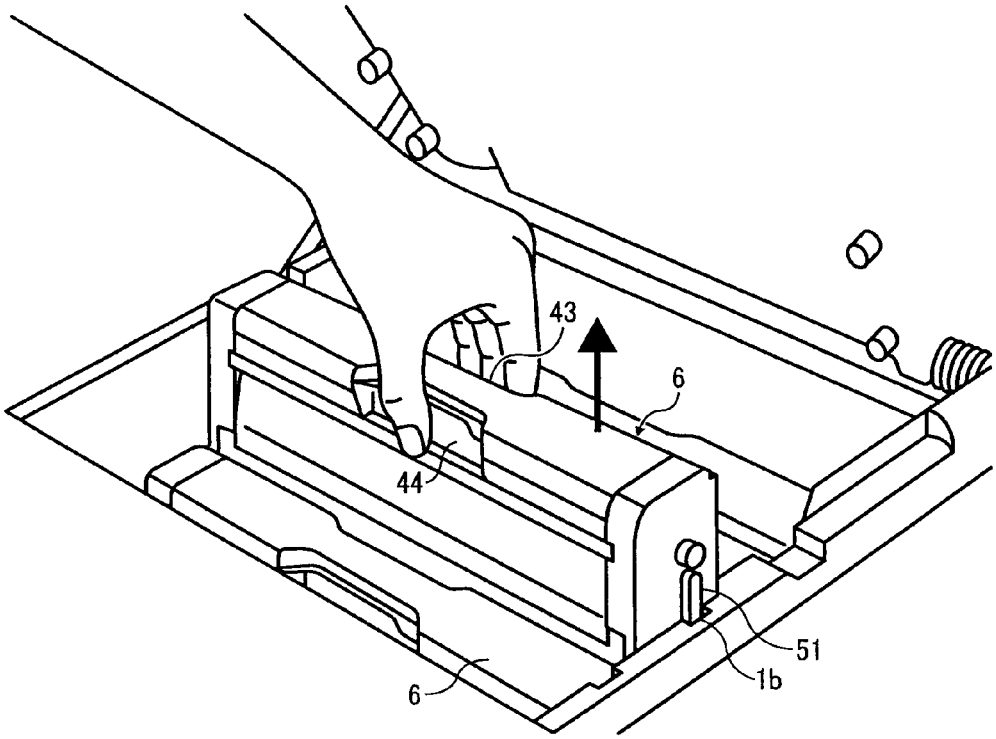
FIG. 4 is a perspective view of the color printer for explaining how the image forming unit is taken out.

The image forming unit 6 is basically replaced by a user. As shown in FIG. 3, when the upper cover 2 is opened together with the exposing unit 5 by the user in such a manner that the front side of the upper cover 2 is pulled up so that the upper cover 2 is revolved around a supporting point 1*a* (see FIG. 1) on the back side of the upper cover 2, the image forming units 6 included in a main body of the color printer 1 appear. The user can take out the image forming unit 6 to be replaced from the color printer 1 by pulling the image forming unit 6 up as shown in FIG. 4. On the other hand, when the image forming unit 6 is attached to the color printer 1, the user puts down the image forming unit 6 so that a guide section 51 on a short-side surface of the image forming unit 6 is fitted in a guide groove 1*b*, and the image forming unit 6 can be set up in the color printer 1 properly.

In this manner, the image forming unit 6 is replaced by the user. According to a conventional technology, the only way the user identifies a color of a toner contained in an image forming unit is to check a color indication labeled to the image forming unit. Therefore, even if the image forming unit is labeled with a wrong color indication, the user attaches the image forming unit to the color printer without recognizing that an actual color of the toner contained in the image forming unit is different from that is shown in the color indication. In addition, even if the image forming unit can be easily attached to or taken out from the color printer, the image forming unit is about 30 centimeters long in a longitudinal direction and weighs over 1 kilogram in general, and also an area to which the image forming unit is attached is not sufficiently wide. Therefore, if a user's handling ability is poor, the user may accidentally drop the image forming unit or hit the image forming unit against the other units, which results in a damage on the image forming unit.

To solve the problems of the conventional image forming unit, the image forming unit 6 according to the embodiment is developed. The image forming unit 6 is explained in detail below.

As shown in FIG. 2, an opening 61 is provided to the image forming unit 6 in the upper left side of the developing roller 30. The opening 61 is set up to face towards the developing roller 30 in such a way that an extended line 33 passing through a tangent line to an outer circumference of the developing roller 30 and a wall 62 of an end of an enclosure of the image forming unit 6 in an axial direction of the developing roller 30 does not intersect with a wall 63 of the other end of the enclosure in a longitudinal direction of the developing roller 30, so that the user can visually recognize the surface of the developing roller 30 through the opening 61 in a direction of an arrow A. In other words, the developing roller 30 is not blocked in the direction of the arrow A because the image forming unit 6 has the opening 61, so that the user can visually recognize a color of a toner thin layer formed on the surface of the developing roller 30. Therefore, even if the image forming unit 6 is mistakenly labeled as a toner which color is different from an actual toner color, the user can recognize the actual toner color. Consequently, when the image forming unit 6 is to be attached to the color printer 1, the user can prevent the image forming unit 6 from being set up improperly due to the mislabeling.

In view of the productivity, the enclosure of the image forming unit 6 is made of injection molded resin, such as polycarbonate resin, acrylonitrile butadiene styrene resin, acrylonitrile styrene resin, styrene resin, polyphenylene ether resin, polyphenylene oxide resin, polyether terephthalate resin, and alloy resin of the above resin. In addition, the resin can be doped with a reinforcement material, such as a glass fiber, a potassium a titanate, a talc, a mica, a wollastonite, and a natural mineral, either alone or in combination. The reinforcement material is generally contained in a range of 5% to 50% by weight of the resin.

Figure 5:
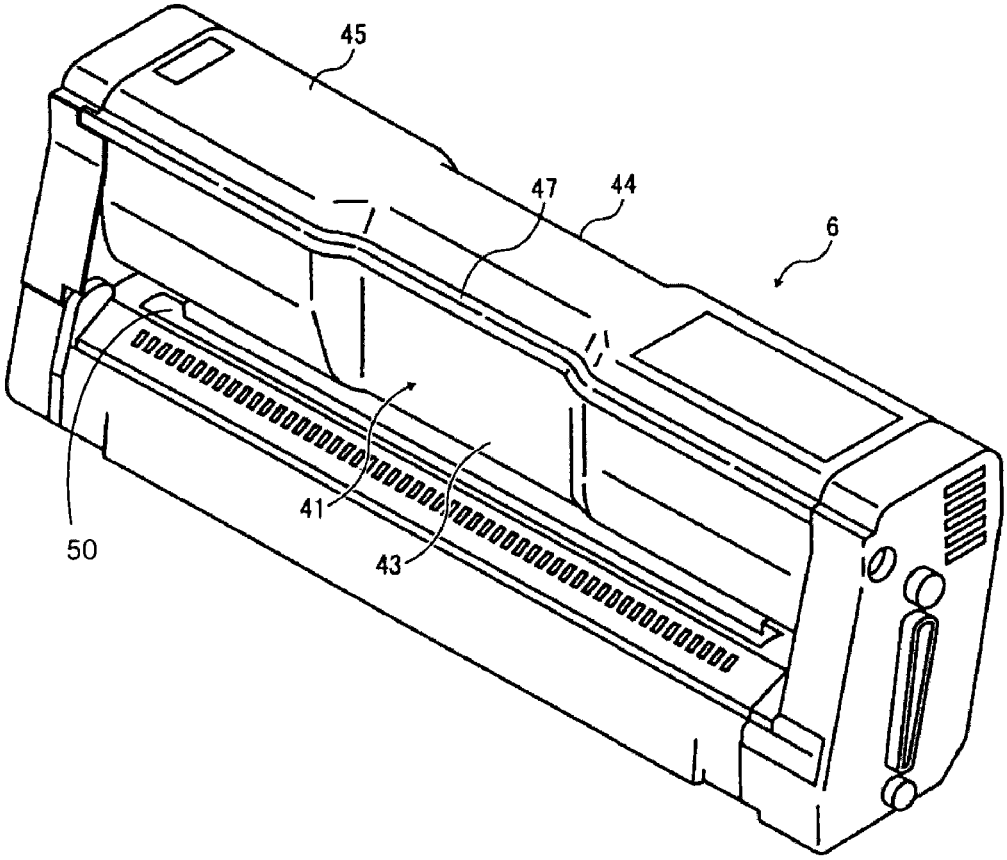
FIG. 5 is a perspective view of the image forming unit.
Figure 6:
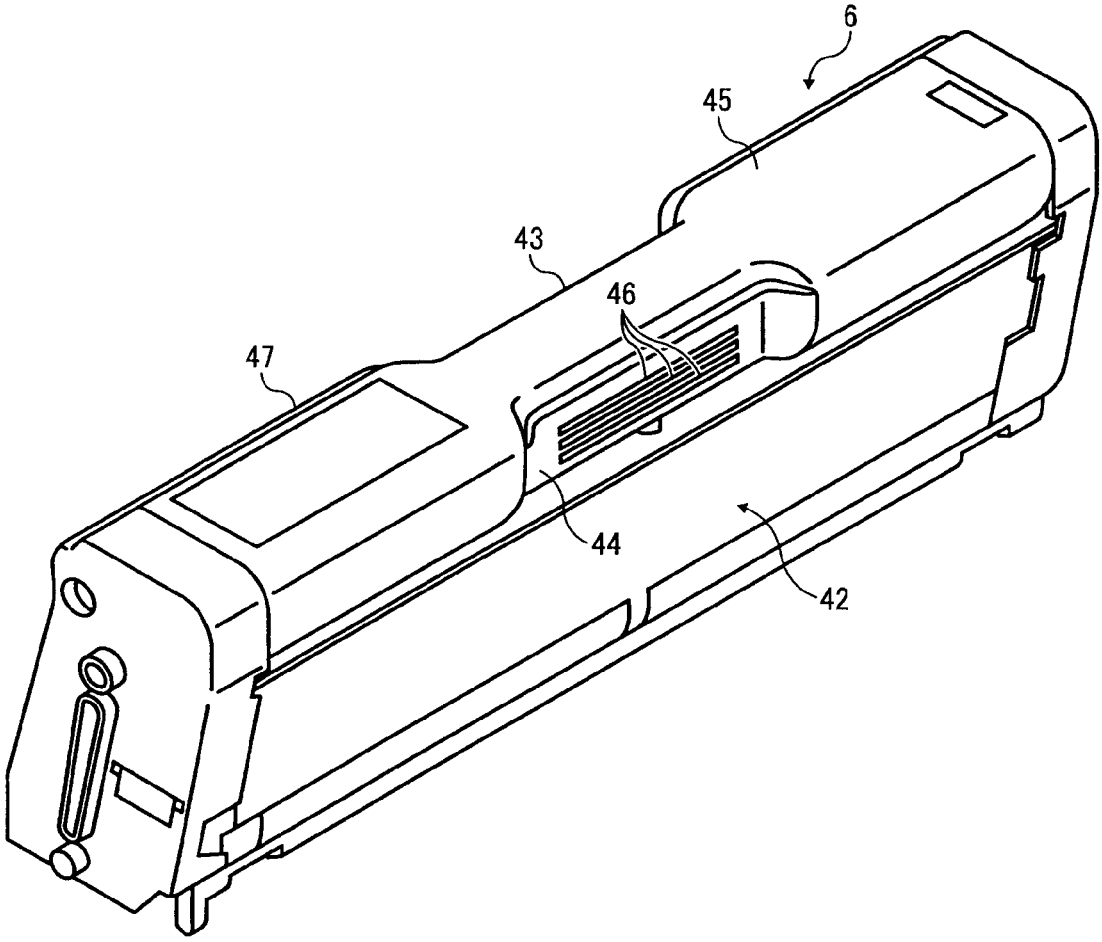
FIG. 6 is a perspective view of the image forming unit viewed from a direction opposite to that is in FIG. 5.

As shown in FIGS. 5 and 6, concave portions 43 and 44 are respectively provided on wall surfaces 41 and 42 that are opposite sides of the maximal side surfaces of the image forming unit 6. The concave portions 43 and 44 are arranged in the substantially middle of the image forming unit 6 in a longitudinal direction viewed from a top surface 45 of the image forming unit 6 to be opposed to each other with keeping a predetermined distance between the concave portions 43 and 44. As shown in FIG. 2, the concave portion 43 is larger than the concave portion 44. The concave portion 44 has a plurality of prominent portions 46 on its surface. The prominent portions 46 act as a slip resistance when the user holds the image forming unit 6.

The user can firmly grip the concave portions 43 and 44 with his fingers when pulling up the image forming unit 6, and thereby enabling to hold the image forming unit 6 easily. Moreover, the photosensitive drum 21 and the developing roller 30 are partially exposed because the image forming unit 6 has the opening 61, so that the partially-exposed portion needs to be protected from being touched by the user. However, with the concave portions 43 and 44, the user can intuitively know where to grip, so that it is possible to prevent the user from touching the partially-exposed portion.

As shown in FIG. 4, when the upper cover 2 is opened, the user grips the concave portion 44 smaller than the concave portion 43 with his thumb and the concave portion 43 with the other four fingers, and takes out the image forming unit 6 from the color printer 1 with one hand easily. In addition, such a replacement of the image forming unit 6 requires only one action in the front side of the color printer 1, so-called a front operation.

As described above, the prominent portions 46 of the concave portion 44 prevent the thumb from being slipped. On the other hand, a joint portion 47 of the concave portion 43 prevents the other four fingers from being slipped. As a result, it is possible to achieve an easy handling of the image forming unit 6 with one hand.

In this manner, the image forming unit 6 according to the embodiment has the opening 61, so that the user can recognize a color of a toner contained in the image forming unit 6 by viewing the toner itself through the opening 61 instead of checking a label of the image forming unit 6 or the like. Furthermore, the concave portions 43 and 44 are provided on the wall surfaces 41 and 42 of the image forming unit 6, so that it is possible to improve the handling ability, and thus the image forming unit 6 can be easily attached to and taken out from the color printer 1.

Incidentally, a foreign substance such as a dust may get into the image forming unit 6 through the opening 61. To prevent the foreign substance from getting into the image forming unit 6, for example, the opening 61 can be covered with a transparent resin film 50, as shown in FIG. 5.

The transparent resin film can be made of polyester resin, polystyrene resin, polyethylene resin, polypropylene resin, polycarbonate resin, polyacrylic resin, polyallirate resin, alloy resin of the above resin, or the like.

It is preferable to attach the transparent resin film to the enclosure of the image forming unit 6 with a double-sided adhesive tape from the viewpoint of the recycling efficiency. However, it is also possible to attach the transparent resin film to the enclosure with an adhesive agent or the like.

Alternatively, an opaque film can be used instead of the transparent resin film if the opaque film has a plurality of apertures so that the user can visually recognize a color of a toner thin layer formed on the surface of the developing roller 30 through the apertures.

In this manner, a process cartridge according to the present embodiment can prevent a wrong setup of the process cartridge due to mislabeling with a simple configuration, and improve the handling ability. Consequently, it is possible to provide a user-friendly image forming apparatus capable of forming a proper image.

In the embodiment, the image forming unit 6 has the form of a cartridge composed of separate enclosures of the developing unit 26 and other units. Therefore, any of the units included in the image forming unit 6, including the developing unit 26, can be taken out from the image forming unit 6, so that the assembly performance can be improved. In other words, any of the units included in the image forming unit 6 can be used until the end of the life because the units can be replaced separately regardless of whether a short-life unit or a short-life unit, and thus it is also possible to improve the recycling efficiency.

The image forming unit 6 according to the present embodiment is applicable to any process cartridge as long as the process cartridge has the form of a cartridge in which the developing unit 26 and any of other units, such as the photosensitive drum 21, the cleaning blade 22, and the charging roller 23, are contained.

According to an aspect of the present invention, a user can visually recognize a color of a toner contained in a process cartridge reliably, so that it is possible to prevent a wrong setup of the process cartridge due to mislabeling. In addition, it is possible to improve the handling ability of the process cartridge when the process cartridge is attached to or taken out from an image forming apparatus in a user-friendly manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge configured to be attached to a main body of an image forming apparatus in a detachable manner, the image forming apparatus including an exposing unit that forms an electrostatic latent image by irradiating a pattern light, and an intermediate transfer unit onto which a toner image is transferred, the process cartridge comprising:

a photosensitive drum that is rotatably supported;

a charging unit that uniformly charges the photosensitive drum;

a developing unit that develops the electrostatic latent image formed on the photosensitive drum with toner to form a toner image on the photosensitive drum;

a cleaning unit that cleans residual toner around the photosensitive drum after transferring the toner image onto the intermediate transfer unit; and a projection at a side of the process cartridge which guides the process cartridge in a vertical direction during insertion into the image forming apparatus, wherein the charging unit, the developing unit, and the cleaning unit are arranged next to the photosensitive drum in an enclosure, the enclosure has an opening through which a developing roller of the developing unit can be seen, an extended line passing through a tangent line to an outer circumference of the developing roller and a wall of a first end of the enclosure in an axial direction of the developing roller does not intersect with a wall of a second end of the enclosure, the opening extends to a top of the enclosure, and a first concave portion is formed on a first surface of the enclosure extending upwards next to the opening and a second concave portion is formed on a second surface of the enclosure on a side opposite to the first surface to be used as a handle.

2. The process cartridge according to claim 1, wherein the enclosure is made of injection molded resin.

3. The process cartridge according to claim 2, wherein the injection molded resin is any one of polycarbonate resin, acrylonitrile butadiene styrene resin, acrylonitrile styrene resin, styrene resin, polyphenylene ether resin, polyphenylene oxide resin, polyether terephthalate resin, and alloy resin.

4. The process cartridge according to claim 1, wherein the second concave portion has a ribbed portion.

5. The process cartridge according to claim 1, wherein an area of the first concave portion is larger than an area of the second concave portion.

6. The process cartridge according to claim 5, wherein the first concave portion and the second concave portion are formed in a middle of the enclosure in the axial direction of the developing roller.

7. The process cartridge according to claim 1, wherein two walls of the enclosure in the axial direction of the developing roller, which form the opening, are formed with separate enclosures.

8. The process cartridge according to claim 1, wherein the opening is covered with a transparent resin film.

9. The process cartridge according to claim 8, wherein the transparent resin film is made of any one of polyester resin, polystyrene resin, polyethylene resin, polypropylene resin, polycarbonate resin, polyacrylic resin, polyallirate resin, and alloy resin.

10. The process cartridge according to claim 9, wherein the transparent resin film is attached to the enclosure with a double-sided adhesive tape.

11. The process cartridge according to claim 1, wherein a cross sectional shape of the enclosure along a surface perpendicular to the axial direction of the developing roller is elongated in a vertical direction, the first and second surfaces vertically extend and face in a direction perpendicular to the axial direction of the developing roller, and the first and second concave portions extend to a top of the enclosure.

* * * * *